US010553374B2

(12) United States Patent
Bahr et al.

(10) Patent No.: US 10,553,374 B2
(45) Date of Patent: Feb. 4, 2020

(54) SWITCHING DEVICE

(71) Applicant: Johnson Electric S.A., Murten (CH)

(72) Inventors: Joachim Bahr, Oldenbutg (DE); Jörg Gaßmann, Dresden (DE); Wassim Hayek, Wermelskirchen (DE); Bernhard Jaworek, Hagen (DE); Martin Tomala, Wuppertal (DE); Andreas Wiencek, Castrop (DE)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 143 days.

(21) Appl. No.: 15/821,133

(22) Filed: Nov. 22, 2017

(65) Prior Publication Data

US 2018/0144883 A1 May 24, 2018

(30) Foreign Application Priority Data

Nov. 22, 2016 (DE) ..... 10 2016 122 423

(51) Int. Cl.
*H01H 13/14* (2006.01)
*H01H 13/04* (2006.01)

(52) U.S. Cl.
CPC ..... *H01H 13/14* (2013.01); *H01H 13/04* (2013.01); *H01H 2221/008* (2013.01)

(58) Field of Classification Search
CPC .. H01H 13/14; H01H 13/04; H01H 2221/008; H01H 25/008; H01H 9/02
USPC ..... 200/330, 573
See application file for complete search history.

(56) References Cited

U.S. PATENT DOCUMENTS 2,468,673 A * 4/1949 Kaminky ..... H01H 13/14 200/335
2,817,725 A * 12/1957 Rochfort ..... H01H 5/04 200/332
3,683,144 A * 8/1972 Bowen ..... H01H 1/26 200/246
3,883,705 A * 5/1975 Sebastian ..... H01H 23/12 200/275
4,092,504 A * 5/1978 Kotaka ..... H01H 11/0056 200/16 D
4,362,916 A * 12/1982 Anderson ..... H01H 13/20 200/332
4,673,778 A * 6/1987 Lewandowski ..... H01H 11/00 200/284
10,153,108 B2 * 12/2018 Tanaka ..... H01H 21/285

* cited by examiner

*Primary Examiner* — Edwin A. Leon
(74) *Attorney, Agent, or Firm* — Muncy, Geissler, Olds & Lowe, P.C.

(57) ABSTRACT

A switching device includes a switch and an actuating element. The actuating element for a switch includes a U-shaped actuating section. The actuating section includes two different arms with different lengths. The long arm is configured to transfer force to a button of the switch and a free end of the long arm is configured for holding the actuating element. The short arm is configured for the force input and is arranged aligned obliquely to the long arm.

17 Claims, 5 Drawing Sheets

SWITCHING DEVICE

CROSS REFERENCE TO RELATED APPLICATIONS

This non-provisional patent application claims priority under 35 U.S.C. § 119(a) from Patent Application No. 10 2016 122 423.5 filed in Germany on Nov. 22, 2016.

TECHNICAL FIELD

The present disclosure relates to a switching device with a switch which is actuated by a push button with an additional actuating element.

BACKGROUND

The switching devices with additional actuating element are already known. These additional actuating elements allow the use of a switch adaptation to different conditions of the device, in particular to different actuating forces and switching paths. In addition to adaptation of several long switching paths and various high actuating forces, adaptation to forces from different directions of action is desired.

Figure 1:
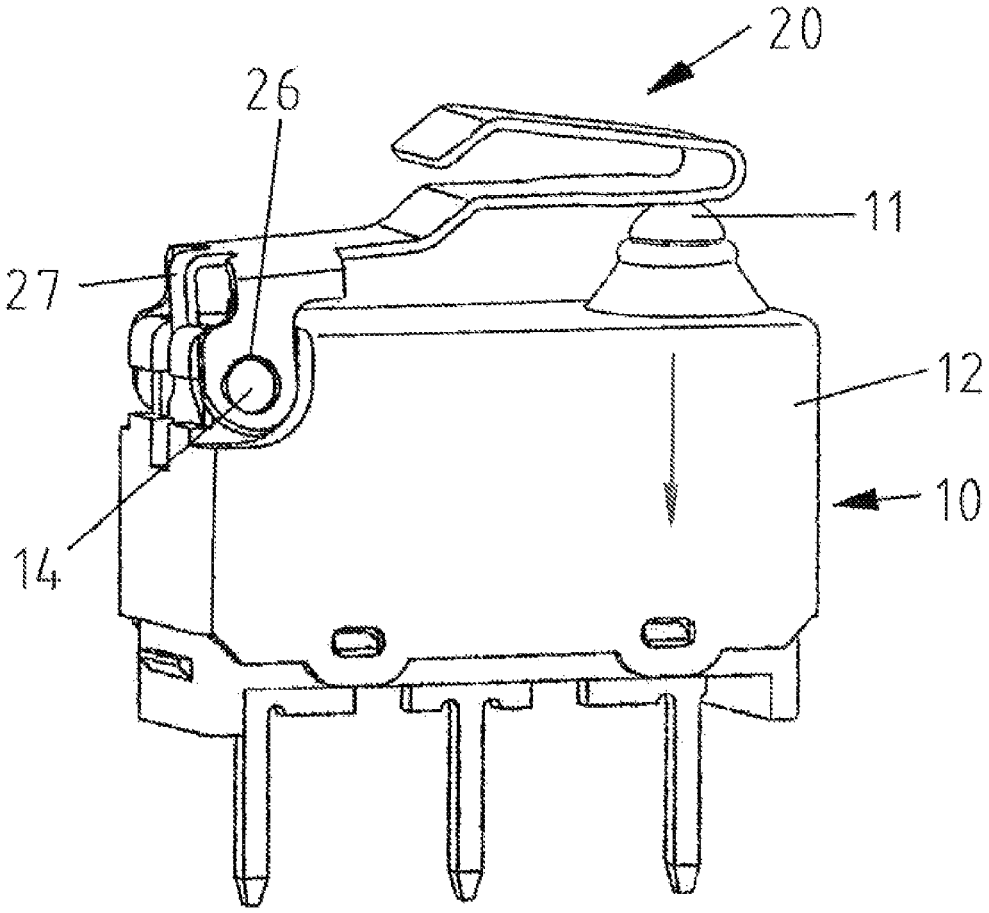
FIG. 1 is a perspective view of an switching device according to the invention.

The following implementations are used for the description of the present disclosure in conjunction with above FIGS.

DETAILED DESCRIPTION OF THE EMBODIMENTS

Hereinafter technical solutions in embodiments of the present disclosure are described clearly and completely in conjunction with the drawings in embodiments of the present disclosure. Apparently, the described embodiments are only some rather than all of the embodiments of the present disclosure. Any other embodiments obtained based on the embodiments of the present disclosure by those skilled in the art without any creative work fall within the scope of protection of the present disclosure. It is understood that, the drawings are only intended to provide reference and illustration, and not to limit the present disclosure. The connections in the drawings are only intended for the clearance of description, and not to limit the type of connections.

It should be noted that, if a component is described to be "connected" to another component, it may be connected to another component directly, or there may be an intervening component simultaneously. All the technical and scientific terms in the present disclosure have the same definitions as the general understanding of those skilled in the art, unless otherwise defined. Herein the terms in the present disclosure are only intended to describe embodiments, and not to limit the present disclosure.

The switching device is shown in FIG. 1 according to one embodiment of the present disclosure. In at least one embodiment, the switching device comprises a switch 10 a cuboid switch housing 12. A push button 11 protrudes out from the top surface of the switch 10. The push button 11 is configured to be pressed along the direction of arrow as shown in FIG. 1, to trigger a switch contact in the housing 12. In at least one embodiment, the switch 10 is a micro-switch.

The switching device further comprises an additional actuating element 20. The actuating element 20 extends along the top surface of the switch 10 and is arranged opposite the push button 11. The actuating element 20 is work as a spring. For mounting, A turning supporting portion 14 is formed at the left side of the one side wall of the housing 12, for turnably supporting the actuating element 20. The turning supporting portion 14 turnably supports the actuating element 20 formed of a plate member having elasticity, with a supporting portion 26 being formed on one end side of the actuating element 20 to the left side in the drawing, such that the supporting portion 26 is supported at the turning supporting portion 14. In at least one embodiment, the supporting portion 26 is a round opening, the turning supporting portion 14 is a circular cylinder, the supporting portion 26 is rotatable sleeved on the turning supporting portion 14.

Figure 2:
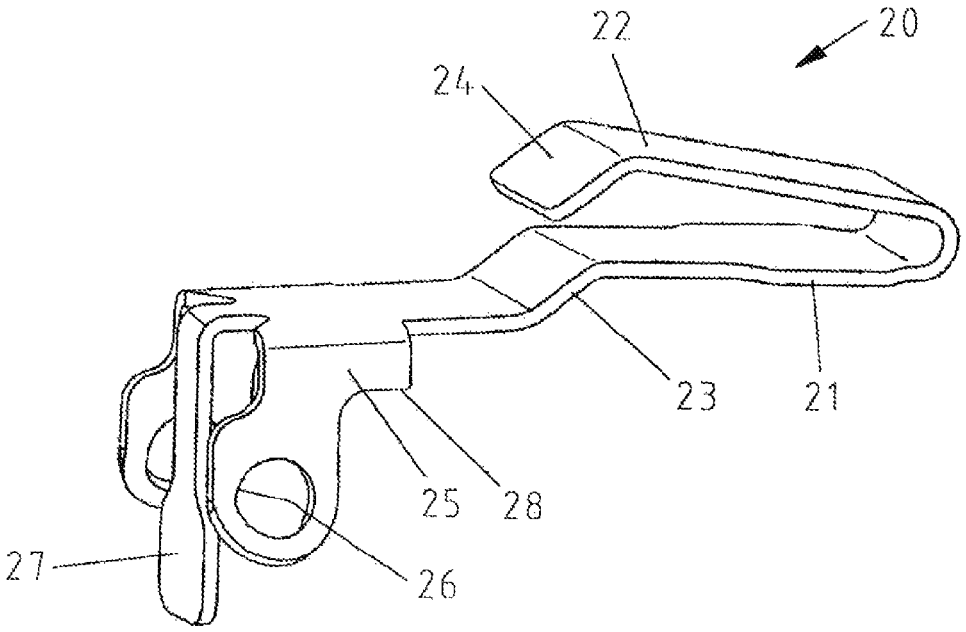
FIG. 2 is a perspective view of the switching device of FIG. 1 with an actuating element.
Figure 5:
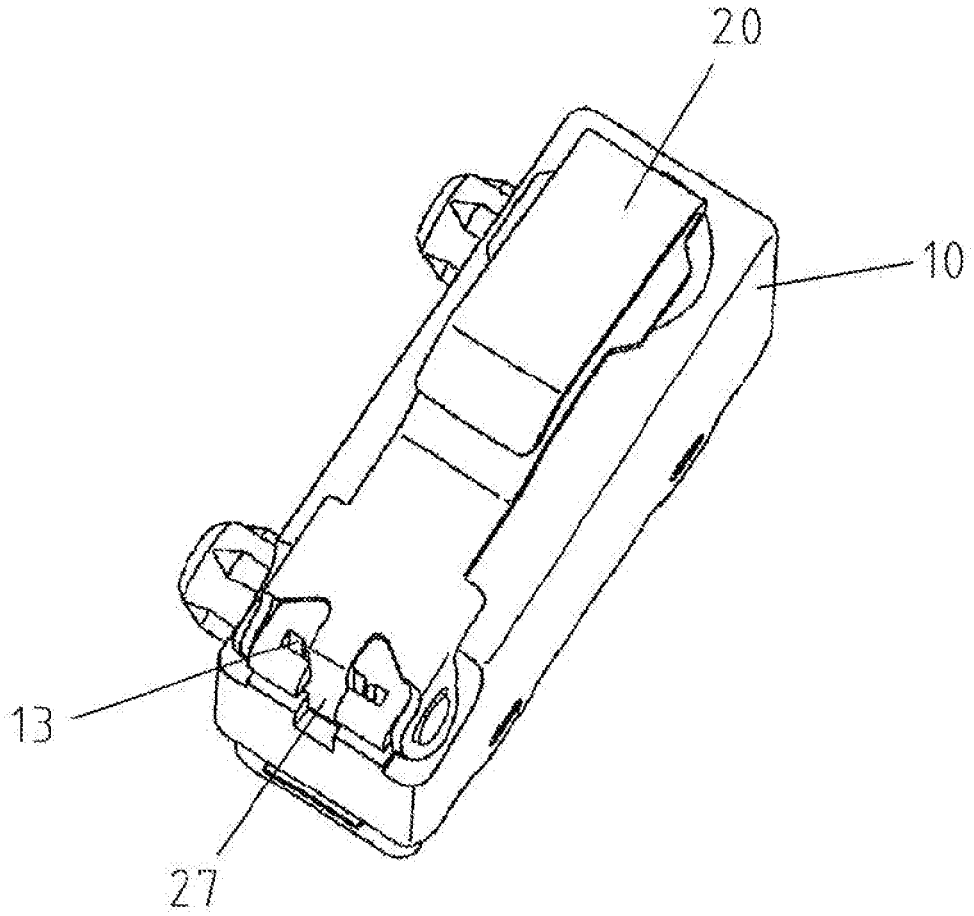
FIG. 5 is a top view of the arrangement of the switching device of FIG. 1.

The actuating element 20 is disposed as a U-shaped shape as shown in FIG. 2 and comprises two arms 21, 22. A bend 23 is formed on the central region of the long arm 21 and extends to the supporting portion 26. Branches 25 are respectively disposed on the both sides at the free end of the long arm 21. A return arm 27 is also disposed at the free end of the long arm. The return arm 27 is bent at a substantially right angle to the long arm 21, so that the actuating element 20 can be elastically returned after being urged and the button 11 is released again. As shown in FIG. 5, the return arm 27 is received in the receiving groove 13 of the housing 12 to fix the braking portion 20. For a secure fixing this return arm 27 in the area is training in form of a flag, with which it sits in the receiving slot 13.

Figure 3:
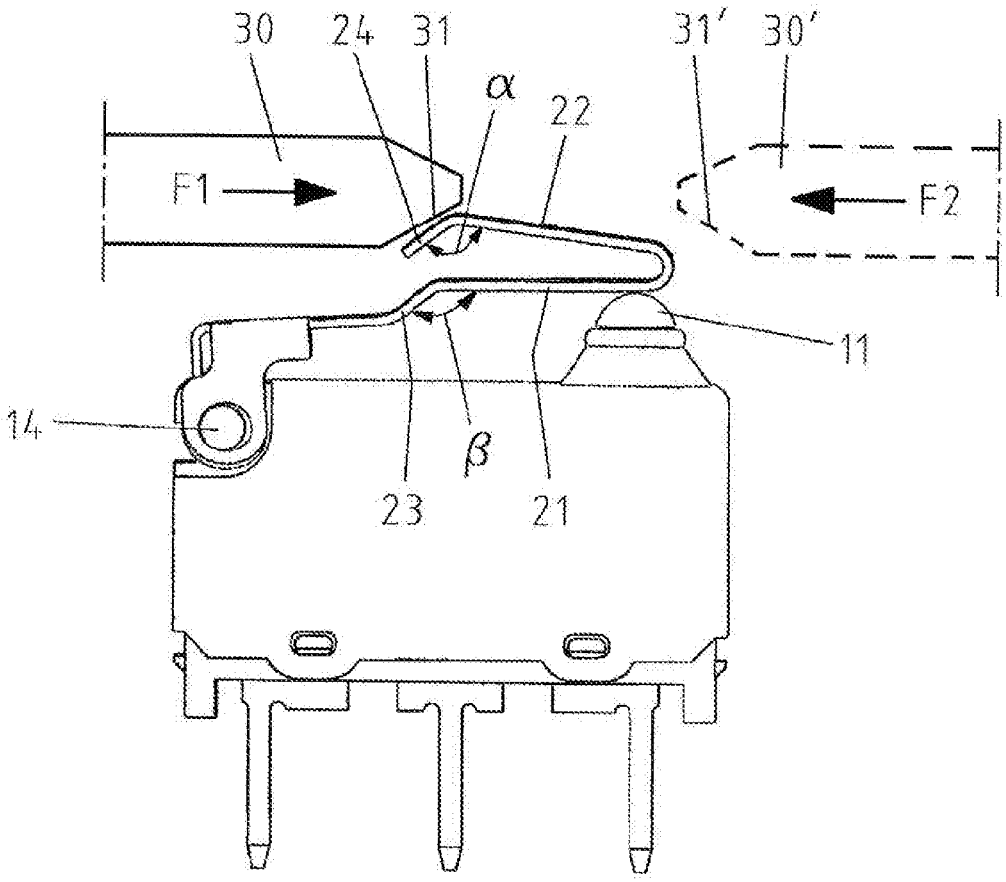
FIG. 3 is a perspective view of the arrangement of the switching device of FIG. 1 additionally with an action member.

The long arm 21 of the actuating element 20 is configured to transmit power to the push button 11. The long arm 21 bears against the push-button 11 of the switch 10 and, upon application of force, can press the push button 11 along its actuating direction, into the housing 12 of the switch 10, press to trigger the switch contact therefore. An external force acts on the short arm 22 of the actuating element 20, that is, the force is applied on the short arm 22. The short arm 22 is, as best seen in FIG. 3, aligned obliquely to the long arm 21 in at least one embodiment. By this orientation, it is possible that an action member 30' exerts a force F2 on the short arm 22 when the abutment side 31' of the action member 30' moves against on the short arm 22.

In at least one embodiment, a bend 24 is disposed at the free end of the short arm 22 such that an obtuse bend angle $\alpha$ results between the bend 24 and the short leg 22, in this embodiment, the bend angle of the bend 24 is 135°. The bend 24 is oriented so that a force F1 from an action member 30 from the other side on the switch 10 can act, because the force F1 is at a touch of the abutment side 31 of the action member 30 at the bend 24 of the short atm 22 introduced into the actuating element 20. Furthermore, the force can also be linear from above or obliquely from the action member.

Figure 4:
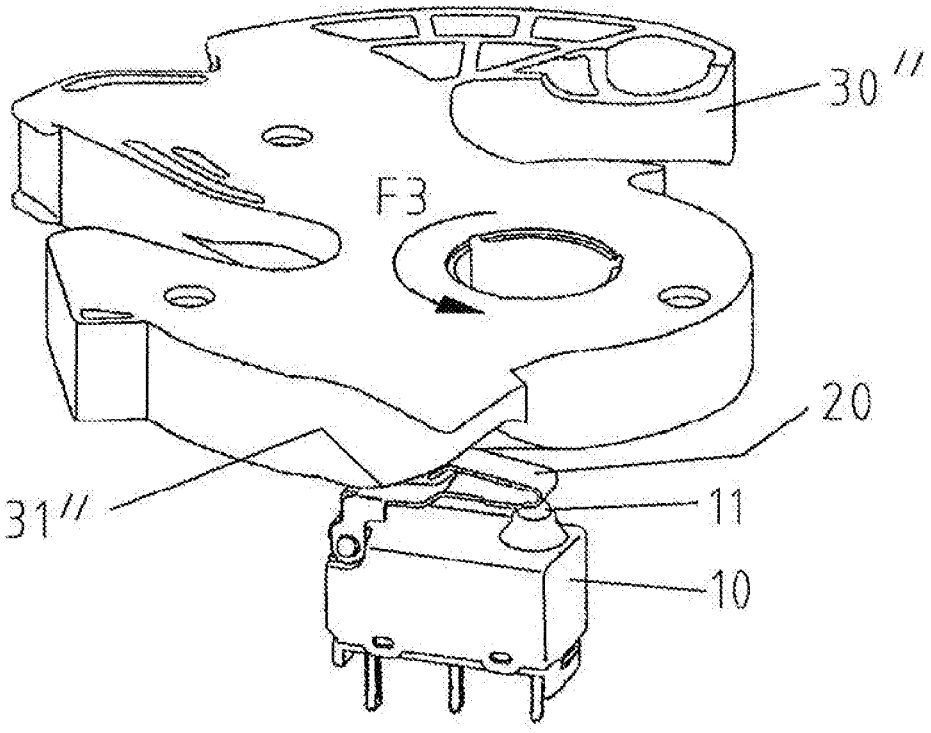
FIG. 4 is a perspective view of the arrangement of the switching device of FIG. 1 additionally with a pawl.

Please refer to FIG. 4 together. In FIG. 4, another actuating element 30" is shown. In this embodiment, the actuating element 30" is a pawl of a locking system. The actuating element 30" comprises an abutment side 31, which in at least one embodiment can apply a rotationally actuating force F3 to the bent 24 of the short arm 22. It is understood that this rotationally actuating force can also be applied in the opposite direction of rotation.

Thus, with this new switching device, a variably deployable switch 10 is available, which can be installed in an electrical device in different orientations, since both a linear force F1, F2 and a rotational force F3 can occur. In at least one embodiment, the additional actuating element 20 in this case has a very compact design. It is located almost in the shadow of the switch 10 and does not exceed this switch 10. An over-stroke is intercepted by the short arm 22. This is further assisted by the fact that a bend 23 is disposed on the long arm 21 below the bend 24 of the short arm 22 likewise provided, as is formed a step on the long arm 21. The bend 23 preferably has a greater or the same angle of curvature β as the angle of curvature α of the bend 24 of the short arm 22, so that the short arm 22 can be lowered beyond the switching point of the contact system of the switch 10 in the direction of the long leg 21 during the over-stroke, to extend the life of switching device.

Furthermore, underside of the branches 25 of the long arm 21, a support point 28 is provided, as shown in FIG. 2. In case of a force is applied to the actuating portion 20, the actuating element 20 can be pivoted slightly about the supporting portion 26, since then the long arm 21 with the support point 28 is supported at the top surface of the switch housing 12.

In at least one embodiment, the actuating element 20 is formed of sheet metal. But it is also possible other leaf spring material, such as plastic.

The switching device according to this invention can be adapted to a large actuation path without additional bulkily operating levers. In addition, actuation forces from different directions of action can be absorbed by the switching device without changing the actuating element.

In the present embodiment, the bend of the short leg can be designed so that it touches the long leg or that it touches the long leg from a certain deflection. As a result, the spring properties can be influenced accordingly.

In the present embodiment, the actuating element 20 is preferably mounted on the housing 12. In other embodiments, the actuating element 20 may be mounted on a device around the switch 10. It is understood that the actuating element 20 has an adapted shape to cooperate with the switch 10 in different arrangements.

In the present embodiment, the return arm 27 is received in the receiving groove 13 of the housing 12 to fix the actuating element 20. In other embodiments, the return arm 27 may be fixed by an adhesive or a rivet connected to the housing 12 of the switch 10, or may also be integrally formed with the housing of the switch 10.

Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated herein should not be interpreted as limits to the present invention, and the scope of the invention is to be determined by reference to the claims that follow.

Described above are preferable embodiments of the present disclosure, which are not intended to limit the present disclosure. All the modifications, equivalent replacements and improvements in the scope of the spirit and principles of the present disclosure are in the protection scope of the present disclosure.

The invention claimed is:

1. A switching device comprising:

a switch, a push button protruding out from a housing of the switch and configured to be pressed to trigger the switch;

an actuating element which is elastic arranged on the switch to operate the push button of the switch upon a force;

wherein the actuating element comprises two different arms with different lengths and the two different arms are disposed as a U-shaped shape, a long arm of the two different arms transfers force to the push-button of the switch, a free end of the long arm holds the actuating element; and wherein a short arm of the two different arms is arranged aligned obliquely to the long arm.

2. The switching device of claim 1, wherein the short arm comprises a bend facing the long arm at the free end of the short arm, in rest position of the actuating element, the bend of the short arm is not touched the long arm.

3. The switching device of claim 1, wherein branches are respectively disposed on both sides at the free end of the long arm with supporting portions respectively, turning supporting portions are formed on the housing of the switch correspondingly for holding the actuating element.

4. The switching device of claim 3, wherein the supporting portion is a round opening, the turning supporting portion is a circular cylinder, the supporting portion is rotatable sleeved on the turning supporting portion.

5. The switching device of claim 1, wherein a return arm is disposed at the free end of the long arm.

6. The switching device of claim 5, wherein a receiving groove is disposed on the housing for receiving the return arm.

7. The switching device of claim 5, wherein the return arm is formed integrally with the switch housing of the switch.

8. The switching device of claim 2, wherein a bend is formed on a central region of the long arm and disposed below the bend of the short arm.

9. The switching device of claim 8, wherein the bend of the long arm is formed a step on the long arm.

10. The switching device of claim 8, wherein an angle of the bend of the short arm is equal to or smaller than an angle of the bend of the long arm.

11. The switching device of claim 1, wherein the actuating element is formed of sheet metal or plastic.

12. The switching device of claim 1, wherein the switch is a microswitch.

13. The switching device of claim 1, wherein the free end of the long arm is mounted on the switch for holding the actuating element.

14. The switching device of claim 1, wherein the free end of the long arm is mounted around the switch for holding the actuating element which is disposed separately from the switch.

15. The switching device of claim 1, wherein the short arm extends along a top surface of the switch.

16. The switching device of claim 1, wherein the short arm and long arm are disposed substantially parallel.

17. The switching device of claim 1, wherein the short arm is formed from an opposed end of the long arm away from the free end, the short arm is extended toward the free end of the long arm from the end of the long arm.

* * * * *